United States Patent [19]

St. Ledger

[11] Patent Number: 4,515,139

[45] Date of Patent: May 7, 1985

[54] LOW MOISTURE SENSITIVE IGNITION

[75] Inventor: Joseph B. St. Ledger, Knoxville, Ill.

[73] Assignee: Outboard Marine Corporation, Waukegan, Ill.

[21] Appl. No.: 544,093

[22] Filed: Oct. 21, 1983

[51] Int. Cl.[3] ..... F02P 3/06

[52] U.S. Cl. ..... 123/599; 123/198 DC; 315/209 CD; 315/218

[58] Field of Search ..... 123/599, 198 DC, 630; 315/209 CD, 218

[56] References Cited

U.S. PATENT DOCUMENTS

| | | | |
|---|---|---|---|
| 3,941,110 | 3/1976 | Sekiguchi | 123/599 |
| 3,964,461 | 6/1976 | Wesemeyer et al. | 123/198 DC |
| 4,036,201 | 7/1977 | Burson | 123/599 |
| 4,193,385 | 3/1980 | Katsumata et al. | 123/630 |
| 4,233,950 | 11/1980 | Krolski et al. | 123/630 |
| 4,297,977 | 11/1981 | Boyama | 123/599 |

*Primary Examiner*—Andrew M. Dolinar

*Attorney, Agent, or Firm*—Michael, Best & Friedrich

[57] ABSTRACT

The capacitor discharge ignition system has a capacitor connected to and charged by a charging coil through a diode. The primary of an ignition transformer is connected to the capacitor and a trigger device controls discharge of the capacitor to ground through said primary coil. The anode of a second diode is connected between the charging coil and the first diode and a shutdown switch is connected in series between the cathode of the second diode and ground.

1 Claim, 1 Drawing Figure

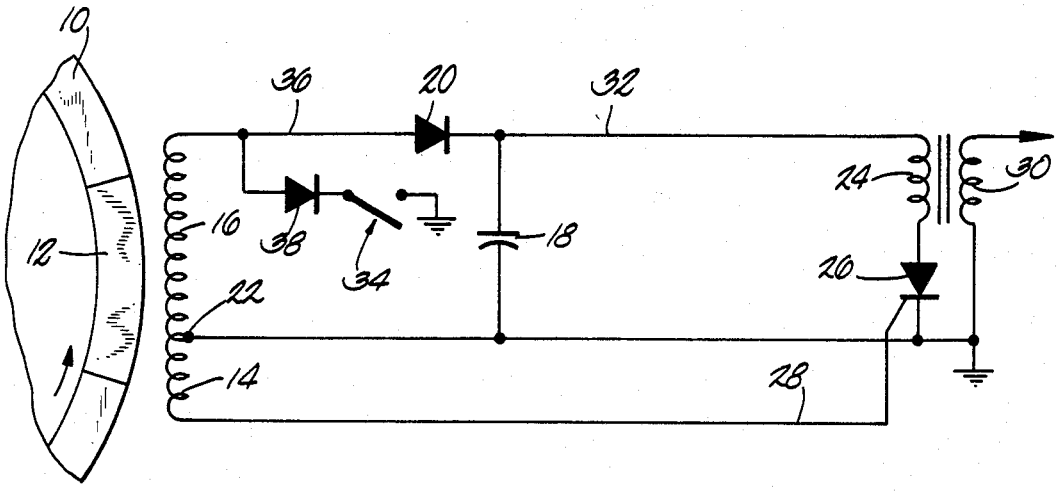
10
12
36
20
32
16
38
34
18
24
30
26
22
14
28

LOW MOISTURE SENSITIVE IGNITION

FIELD OF THE INVENTION

This invention relates to capacitor discharge ignition systems and particularly to the means for shutting down the system.

BACKGROUND OF THE INVENTION

Capacitor discharge ignition systems apply the charging voltage to a capacitor through a diode. The charge stored on the capacitor is discharged through the primary of the ignition transformer when a silicon controlled rectifier (SCR) is fired at the appropriate time. Ignition has been terminated by shorting the capacitor to ground. The switch is exposed to the high voltage on the capacitor. Any leakage or shorting at the switch due to high ambient moisture (and/or dirt) conditions will result in reduced voltage across the spark plug or in shorting out the ignition system.

The time the shutdown switch is exposed to high voltage can be reduced by connecting the switch between the charging coil side of the diode and ground so the switch is exposed to only pulses of high voltage instead of the longer duration charge on the capacitor. When so connected, the switch would, however, be subjected to a high negative voltage spike not used in the CD ignition system. To overcome that problem, U.S. Pat. No. 3,964,461 provides two diodes in series between the charging coil and the capacitor and connects the shutdown switch between the diodes so the diodes act to protect the switch against high negative spikes and against the charge on the capacitor. That arrangement charges the capacitor through two diodes which inherently increases the charge time and increases (doubles) the power loss. This reduces the voltage across the spark plug.

SUMMARY OF THE INVENTION

The principal object of this invention is to provide a capacitor discharge ignition system in which a capacitor is connected to and charged by a charging coil through a diode. The capacitor is discharged through the primary of an ignition transformer when grounded by a trigger device. The shutdown switch is in series with a second diode having its anode connected to the connection between the charging coil and the first diode. The switch grounds the charge coil when closed. The second diode protects the switch against the high negative voltage spikes in the charging coil. The capacitor is charged through only the first diode and the charging time remains the same.

BRIEF DESCRIPTION OF THE DRAWINGS

The schematic wiring diagram illustrates the present invention.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWINGS

The capacitor discharge ignition system shown in the drawing has a rotor 10 in which permanent magnet 12 is mounted to pass in close proximity to trigger coil 14 and charging coil 16. The output of the charging coil is applied to the capacitor 18 through diode 20. The other side of the capacitor 18 is connected to ground as is the tap 22 of the coil. The charge of the capacitor 18 is discharged through the primary 24 of the ignition transformer when the SCR 26 is triggered by voltage applied to the SCR through lead 28 from the trigger coil 14. Thus, when the SCR 26 is triggered, the charge on the capacitor passes to ground through the SCR. This induces a high (typically 30,000 volts) voltage in the secondary 30 of the ignition transformer.

It will be noted that with the rotor 10 rotating counter-clockwise as indicated, the charge applied to the capacitor remains on the capacitor for substantially one revolution of the rotor before trigger voltage will be generated in the trigger coil 14 to discharge the capacitor through the SCR. In the past the typical CD ignition system was shut down by closing a switch to connect lead 32 to ground to short the capacitor 18 to ground. The problem with this arrangement is that the switch had the capacitor voltage across the switch for one revolution of the rotor which, in the scheme of things, is a long time. Under high moisture conditions, or if the switch got dirty, there could be leakage across the switch or the switch would short to ground. This either meant the voltage on the secondary 30 of the spark coil was reduced or in fact the system was shorted out.

To overcome the foregoing problem, the present system is shut down by connecting lead 36 between the charging coil 16 and diode 20 to ground through a second diode 38 and switch 34. With this arrangement the switch is isolated from the charge on the capacitor by diode 20. Diode 38 protects the switch from the high negative voltage spike in lead 36. Diode 38 will allow the charging pulse across the switch, but moisture conditions at the switch will have no appreciable effect due to the short pulse time. Diode 38 is located out of the charging path and therefore does not adversely affect the charge time nor does it cause a power loss in the charging system. It is therefore an improvement over the prior art in that the circuit is insulated from the adverse effects of high ambient moisture without any reduction of the spark voltage and without increasing the charge time.

I claim:

1. A capacitor discharge ignition system comprising, a charging coil, a first diode having an anode and a cathode, a direct connection between said anode and said coil, a capacitor connected to said cathode for charging by said coil, an ignition transformer having a primary and a secondary winding, said primary winding being connected to said capacitor, a trigger device connected to said primary winding to discharge said capacitor to ground through said primary winding, a second diode having an anode directly connected to said connection between said charging coil and said first diode and also having a cathode, and a shutdown switch connected in series between said cathode of said second diode and ground.

* * * * *